US007229337B2

(12) United States Patent
Lim et al.

(10) Patent No.: US 7,229,337 B2
(45) Date of Patent: Jun. 12, 2007

(54) POLISHING PAD, PLATEN, METHOD OF MONITORING, METHOD OF MANUFACTURING, AND METHOD OF DETECTING

(75) Inventors: Young-Sam Lim, Seoul (KR); Dong-Jun Lee, Seoul (KR); Nam-Soo Kim, Suwon (KR); Sung-Taek Moon, Suwon (KR); Kyoung-Moon Kang, Gwangmyeong (KR); Jae-Hyun So, Sadangu (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 183 days.

(21) Appl. No.: 10/726,637

(22) Filed: Dec. 4, 2003

(65) Prior Publication Data

US 2004/0253910 A1 Dec. 16, 2004

(30) Foreign Application Priority Data

Jun. 16, 2003 (KR) ..... 10-2003-0038740

(51) Int. Cl.
*B24B 19/00* (2006.01)

(52) U.S. Cl. ..... 451/6; 451/10; 451/11; 451/287

(58) Field of Classification Search ..... 451/41, 451/285, 287, 288, 6, 8, 10, 11, 526, 530, 451/533
See application file for complete search history.

(56) References Cited

U.S. PATENT DOCUMENTS

| | | | | |
|---|---|---|---|---|
| 6,045,439 | A * | 4/2000 | Birang et al. | 451/526 |
| 6,261,155 | B1 * | 7/2001 | Jairath et al. | 451/41 |
| 6,832,949 | B2 * | 12/2004 | Konno et al. | 451/285 |
| 6,855,034 | B2 * | 2/2005 | Hasegawa | 451/41 |
| 6,884,156 | B2 * | 4/2005 | Prasad et al. | 451/533 |
| 6,887,136 | B2 * | 5/2005 | Smith | 451/57 |
| 6,896,585 | B2 * | 5/2005 | Tolles | 451/6 |
| 6,935,922 | B2 * | 8/2005 | Lehman et al. | 451/5 |
| 6,953,515 | B2 * | 10/2005 | Boyd et al. | 156/345.16 |
| 6,986,699 | B2 * | 1/2006 | Wiswesser et al. | 451/6 |

* cited by examiner

*Primary Examiner*—Eileen P. Morgan
(74) *Attorney, Agent, or Firm*—Harness, Dickey & Pierce, P.L.C.

(57) ABSTRACT

A polishing pad, platen, method of monitoring, method of manufacturing, and method of detecting using a pseudo window area, where the pseudo window area has a thickness less than a thickness of a polishing layer and a thickness greater than zero.

11 Claims, 5 Drawing Sheets

POLISHING PAD, PLATEN, METHOD OF MONITORING, METHOD OF MANUFACTURING, AND METHOD OF DETECTING

CROSS-REFERENCE TO RELATED APPLICATION

This application claims the benefit of priority of Korean Patent Application No. 2003-38740, filed on 16 Jun. 2003, in the Korean Intellectual Property Office, the contents of which are herein incorporated by reference in their entirety.

BACKGROUND OF THE INVENTION

Polishing pads, such as chemical mechanical polishing (CMP) pads are widely used in a semiconductor manufacturing field to horizontally planarize various types of layers, such as oxide layers, nitride layers, metal layers, etc. In one conventional arrangement, a CMP pad is provided with a hole H. A chuck including a wafer to be planarized is placed in contact with the CMP pad including the hole H. A slurry is provided on the polishing pad to facilitate the CMP process and a light reflectance measurement unit is used to determine when the wafer has been sufficiently planarized. The end point of the polishing process is determined by the light reflectance measurement unit by measuring the light reflected through the hole or window H. However, the ability of the slurry to fall through the hole in the CMP pad reduces the accuracy of the measurements made by the light reflectance measurement unit.

In another conventional device, the CMP pad does not include a hole. In such an arrangement, the progress of the polishing cannot be monitored in-situ and a manufacturing delay is introduced when the wafer must be removed from the CMP process to check the progress of the polish. In such a system, the end point of the polishing process may be determined utilizing a preset timing period. However, such systems are inherently inaccurate.

In yet another conventional device, a pad window is inserted in the hole of a top polishing pad. The pad window is made of a transparent material, which allows transmission of the laser beam. However, in the conventional device, the pad window sags in downwardly and/or an interface gap occurs between the top polishing pad and the window due to mechanical polishing pressure. As a result, slurry may accumulate on the top surface of the sagging pad window or slurry may leak through gaps in the side. Each of these causes scattering of the laser beam and degrades the transmission.

SUMMARY OF THE INVENTION

In exemplary embodiments, the present invention is directed to a chemical mechanical polishing (CMP) pad for in situ monitoring which includes a polishing layer including a pseudo window area, where the pseudo window area has a thickness less than a thickness of the polishing layer and a thickness greater than zero.

In exemplary embodiments, the present invention is directed to a chemical mechanical polishing (CMP) pad for in situ monitoring which includes a polishing layer having a recessed region, thereby forming a pseudo window area adjacent to the recessed region.

In exemplary embodiments, the present invention is directed to a chemical mechanical polishing (CMP) pad for in situ monitoring, which includes a polishing layer including a transparent supporting layer, thereby forming a pseudo window area adjacent to the transparent supporting layer.

In an exemplary embodiment, the present invention is directed to a chemical mechanical polishing (CMP) platen for in situ monitoring, comprising a platen layer including a platen window, the platen window recessed within the platen layer.

In exemplary embodiments, the present invention is directed to a chemical mechanical polishing (CMP) platen for in situ monitoring, which includes a platen layer including a platen window, the platen window protruding higher than a height of the platen layer.

In exemplary embodiments, the present invention is directed to a method of monitoring a chemical mechanical polishing (CMP) process in situ, which includes providing a chemical mechanical polishing (CMP) pad on a platen, the chemical mechanical polishing (CMP) pad including a polishing layer and a pseudo window area, the pseudo window area having a thickness less than a thickness of the polishing layer and a thickness greater than zero and monitoring light passed through the pseudo window area to control the chemical mechanical polishing (CMP) process.

In exemplary embodiments, the present invention is directed to a method of monitoring a chemical mechanical polishing (CMP) process in situ, which includes providing a chemical mechanical polishing (CMP) pad on a platen, the chemical mechanical polishing (CMP) pad including a polishing layer having a recessed region, thereby forming a pseudo window area adjacent to the recessed region, the pseudo window area having a thickness less than a thickness of the polishing layer and a thickness greater than zero and monitoring light passed through the pseudo window area to control the chemical mechanical polishing (CMP) process.

In exemplary embodiments, the present invention is directed to a method of monitoring a chemical mechanical polishing (CMP) process in situ, which includes providing a chemical mechanical polishing (CMP) pad on a platen, the chemical mechanical polishing (CMP) pad including a polishing layer and a transparent supporting layer, thereby forming a pseudo window area adjacent to the transparent supporting layer and monitoring light passed through the pseudo window area to control the chemical mechanical polishing (CMP) process.

In exemplary embodiments, the present invention is directed to a method of monitoring a chemical mechanical polishing (CMP) process in situ, which includes providing a chemical mechanical polishing (CMP) pad on a platen, the chemical mechanical polishing (CMP) pad including a polishing layer and a pseudo window area and the platen including a platen layer and a platen window, the platen window protruding higher than a height of the platen layer and monitoring light passed through the pseudo window area to control the chemical mechanical polishing (CMP) process.

In exemplary embodiments, the present invention is directed to a method of manufacturing a chemical mechanical polishing (CMP) pad for in situ monitoring of a chemical mechanical polishing (CMP) process, which includes providing a polishing layer and forming a pseudo window area in the polishing layer, the pseudo window area having a thickness less than a thickness of the polishing layer and a thickness greater than zero.

In exemplary embodiments, the present invention is directed to a method of manufacturing a chemical mechanical polishing (CMP) pad for in situ monitoring of a chemical mechanical polishing (CMP) process, which includes providing a polishing layer and forming a recessed region in the polishing layer to form a pseudo window area adjacent to the recessed region.

In exemplary embodiments, the present invention is directed to a method of manufacturing a chemical mechanical polishing (CMP) pad for in situ monitoring of a chemical mechanical polishing (CMP) process, which includes providing a polishing layer, forming a recessed region in the polishing layer, and arranging a transparent supporting layer in the recessed region, thereby forming a pseudo window area adjacent to the transparent supporting layer.

In exemplary embodiments, the present invention is directed to a method of manufacturing a platen for in situ monitoring of a chemical mechanical polishing (CMP) process, which includes providing a platen layer, forming a hole in the platen layer, and arranging a platen window in the hole, the platen window protruding higher than a height of the platen layer.

In exemplary embodiments, the present invention is directed to a method of detecting an end point in situ, which includes providing a pad on a platen, the pad including a polishing layer and a pseudo window area, the pseudo window area having a thickness less than a thickness of the polishing layer and a thickness greater than zero and monitoring light passed through the pseudo window area to detect the end point.

In exemplary embodiments, the present invention is directed to a method of detecting an end point in situ, which includes providing a pad on a platen, the pad including a polishing layer having a recessed region, thereby forming a pseudo window area adjacent to the recessed region, the pseudo window area having a thickness less than a thickness of the polishing layer and a thickness greater than zero and monitoring light passed through the pseudo window area to detect the end point.

In exemplary embodiments, the present invention is directed to a method of detecting an end point in situ, which includes providing a pad on a platen, the pad including a polishing layer and a transparent supporting layer, thereby forming a pseudo window area adjacent to the transparent supporting layer and monitoring light passed through the pseudo window area to detect the end point.

In exemplary embodiments, the present invention is directed to a method of detecting an end point in situ, which includes providing a pad on a platen, the pad including a polishing layer and a pseudo window area and the platen including a platen layer and a platen window, the platen window protruding higher than a height of the platen layer and monitoring light passed through the pseudo window area to detect the end point.

BRIEF DESCRIPTION OF THE DRAWINGS

The present invention will become more fully understood from the detailed description given below and the accompanying drawings, which are given for purposes of illustration only, and thus do not limit the invention.

DETAILED DESCRIPTION OF EXEMPLARY EMBODIMENTS

Figure 1:
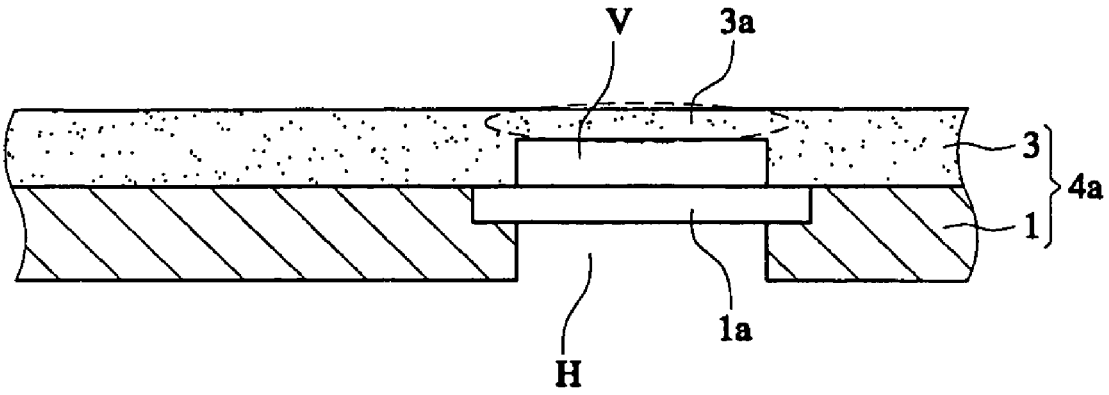
FIG. 1 illustrates a polishing table in accordance with an exemplary embodiment of the present invention.

FIG. 1 illustrates a polishing table 4*a* in accordance with an exemplary embodiment of the present invention. As illustrated, the polishing table 4*a* includes a platen 1 and a polishing pad 3. The polishing pad 3 includes an in-situ window area 3*a* which may be semi-transparent. The platen 1 may include a platen window la. The geometries of the platen 1 and the polishing pad 3 shown in FIG. 1 form a hole H and a void V. The void V may be filled with air or another gas. As illustrated in FIG. 1, the polishing pad 3 does not contain a through hole. A top surface of the platen 1 and a stepped bottom surface of the polishing pad 3 define the void V. In an exemplary embodiment, the polishing pad 3 is made of syndiotatic 1,2-polybutadiene, polyurethane, or polybutadiene (PBD) which are semi-transparent materials. In an exemplary embodiment, the in-situ window area 3*a* has a thickness in the range of between 1.0 mm and 2.0 mm or 1.5 mm and 2.0 mm to allow light transmission.

In an exemplary embodiment, the platen 1 is made of a metal material, such as stainless steel. As illustrated in FIG. 1, an upper surface of the platen window 1*a* is at the same or substantially the same level as the upper surface of the platen 1. In an exemplary embodiment, the platen window 1*a* is made of a transparent material, such as polycarbonate, polyethylene terephthalate glycol, polypropylene, 2-aryl glycol carbonate, quartz or glass. In an exemplary embodiment, the void V is positioned above the hole H of the platen 1. In an exemplary embodiment, the void V is formed by the recessed region between the pseudo window 3*a* and the platen window 1*a*.

Figure 2:
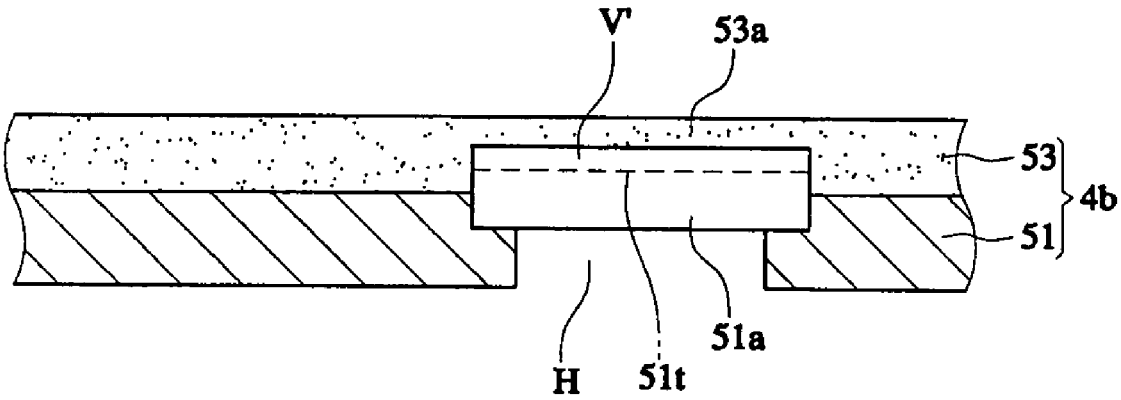
FIG. 2 illustrates a polishing table in accordance with another exemplary embodiment of the present invention.

FIG. 2 illustrates another exemplary embodiment of the present invention. As shown in FIG. 2, the polishing table 4*b* includes a platen 51 and a polishing pad 53. In the exemplary embodiment illustrated in FIG. 2, the platen 51 and the polishing pad 53 are essentially the same as the platen 1 and polishing pad 3 of FIG. 1; however, in the exemplary embodiment of FIG. 2, the top surface level of the platen window 51*a* is above the top level of the platen 51. In an exemplary embodiment, this configuration may allow for easier self-alignment.

In an exemplary embodiment, the top surface level of the platen window 51*a* is sufficiently higher above the top level of the platen 51, that no void V is formed. In an exemplary embodiment, the void V' in FIG. 2 is smaller than the void V of FIG. 1 due to the top surface level of the platen window 51*a* being above the level of the top level of the platen 51. In an exemplary embodiment, the platen window 51*a* protrudes from the platen 51 in a direction closer to the polishing pad, to thereby reduce the size of or eliminate altogether, the void V'.

Figure 3:
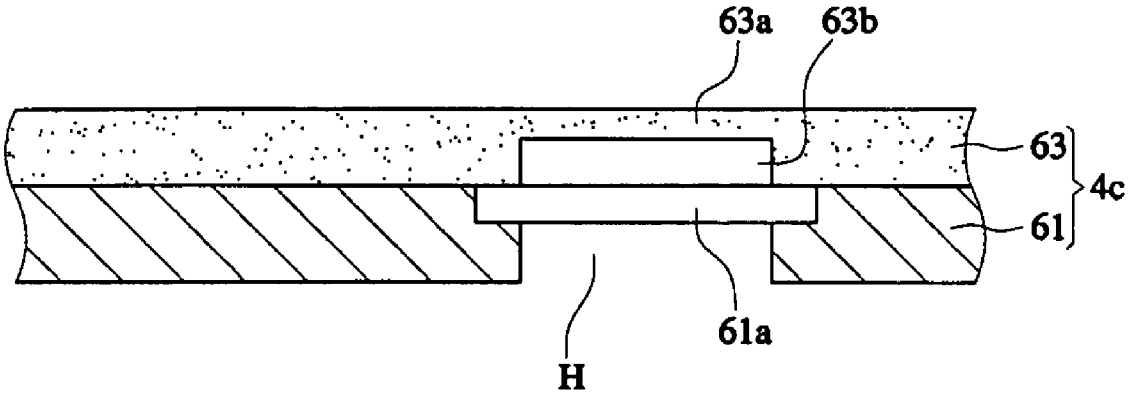
FIG. 3 illustrates a polishing table in accordance with another exemplary embodiment of the present invention.

FIG. 3 illustrates another exemplary embodiment of the present invention. As illustrated in FIG. 3, the polishing table 4*c* includes a platen 61 and a polishing pad 63. In the exemplary embodiment illustrated in FIG. 3, the polishing pad 63 is essentially the same configuration as that of the polishing pad 3 of FIG. 1; however, a transparent supporting layer 63*b* is inserted in the recessed region of the polishing pad 63. In an exemplary embodiment, the transparent supporting layer 63*b* helps prevent the pseudo window area 63*a* from being deformed due to mechanical pressure by a wafer chuck. In an exemplary embodiment, the transparent supporting layer 63*b* is made of the same material as that of the platen window 61.

Figure 4:
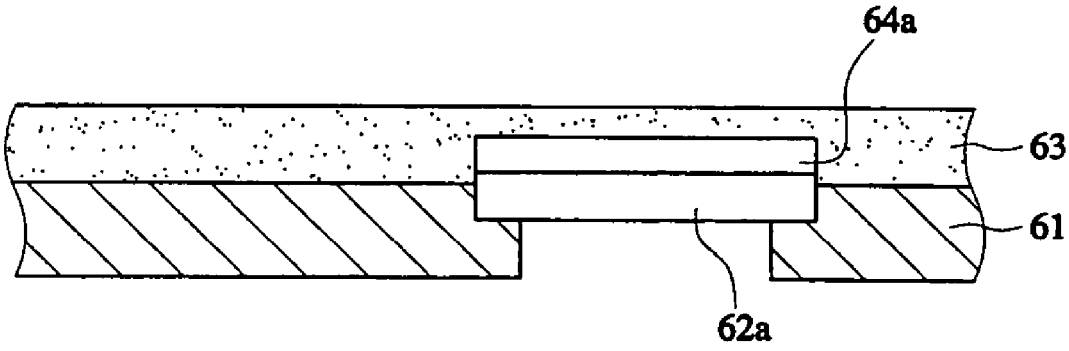
FIG. 4 illustrates a polishing table in accordance with another exemplary embodiment of the present invention.

In another exemplary embodiment illustrated in FIG. 4, the polishing table 4*d* includes a platen 61 and a polishing pad 63. As illustrated in FIG. 4, the platen window 62*a* protrudes from the platen 61 (such as in shown in FIG. 2) and a transport parent supporting layer 64*a* is inserted between the in-situ window area and the platen window 62*a* (such as in shown in FIG. 3).

Figure 5:
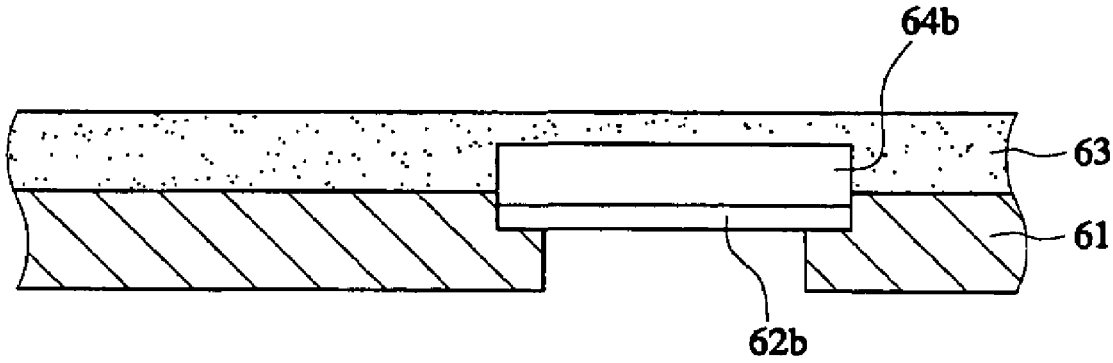
FIG. 5 illustrates a polishing table in accordance with another exemplary embodiment of the present invention.

In another exemplary embodiment illustrated in FIG. 5, the transparent supporting layer 64*b* protrudes from a bottom surface of the polishing pad 63 and its protrusion is inserted into the platen window 62*b* of the platen 61.

In other exemplary embodiments, the various pad and platen features of the present invention illustrated in FIGS. 1–5 may be utilized either singly or in any combination.

In exemplary embodiments, the various pad and platen features of the present invention illustrated in FIGS. 1–5 may be utilized in an in-situ end point detection (EPD) system; such an exemplary optical system is illustrated in U.S. Pat. No. 5,433,651.

Figure 6:
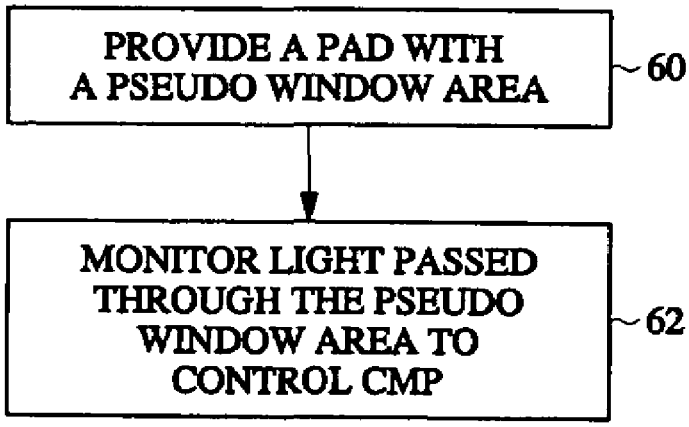
FIG. 6 illustrates a method of monitoring a chemical mechanical polishing (CMP) process in situ in accordance with another exemplary embodiment of the present invention.

FIG. 6 illustrates a method of monitoring a chemical mechanical polishing (CMP) process in situ in accordance with another exemplary embodiment of the present invention. As illustrated, the flowchart of FIG. 6 includes a step 60 of providing a pad with a pseudo window area and a step 62 of monitoring light passed through the pseudo window area to control the chemical mechanical polishing (CMP) process.

Figure 7:
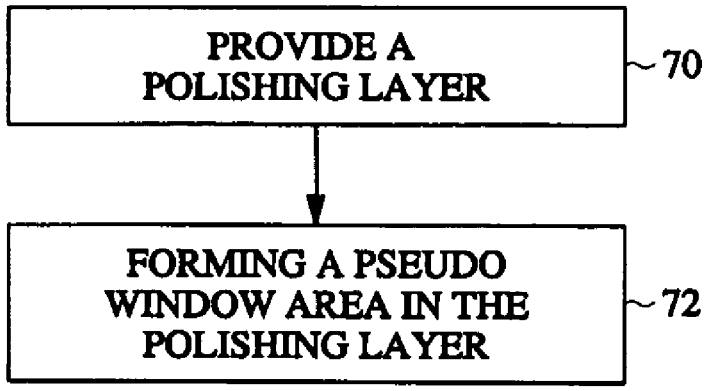
FIG. 7 illustrates a method of manufacturing a chemical mechanical polishing (CMP) pad for in situ monitoring of a chemical mechanical polishing (CMP) process in accordance with another exemplary embodiment of the present invention.

FIG. 7 illustrates a method of manufacturing a chemical mechanical polishing (CMP) pad for in situ monitoring of a chemical mechanical polishing (CMP) process in accordance with another exemplary embodiment of the present invention. As illustrated, the flowchart of FIG. 7 includes a step 70 of providing a polishing layer and a step 72 of forming a pseudo window area in the polishing layer.

In an exemplary embodiment of the present invention, the polishing layer is formed by one of molding, extruding, or grinding.

Figure 8:
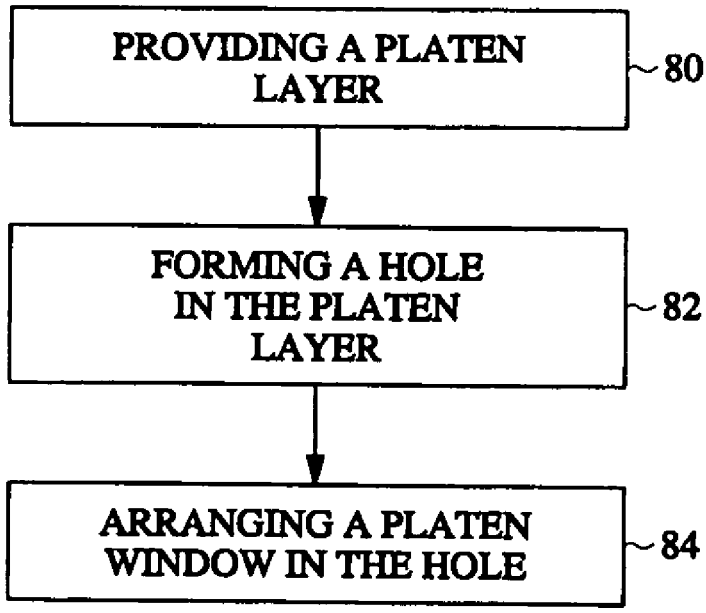
FIG. 8 illustrates a method of manufacturing a platen for in situ monitoring of a chemical mechanical polishing (CMP) process in accordance with another exemplary embodiment of the present invention.

FIG. 8 illustrates a method of manufacturing a platen for in situ monitoring of a chemical mechanical polishing (CMP) process in accordance with another exemplary embodiment of the present invention. As illustrated, the flowchart of FIG. 8 includes a step 80 of providing a platen layer, a step 82 of forming a hole in the platen layer, and a step 84 of arranging a platen window in the hole, the platen window protruding higher than a height of the platen layer.

Figure 9:
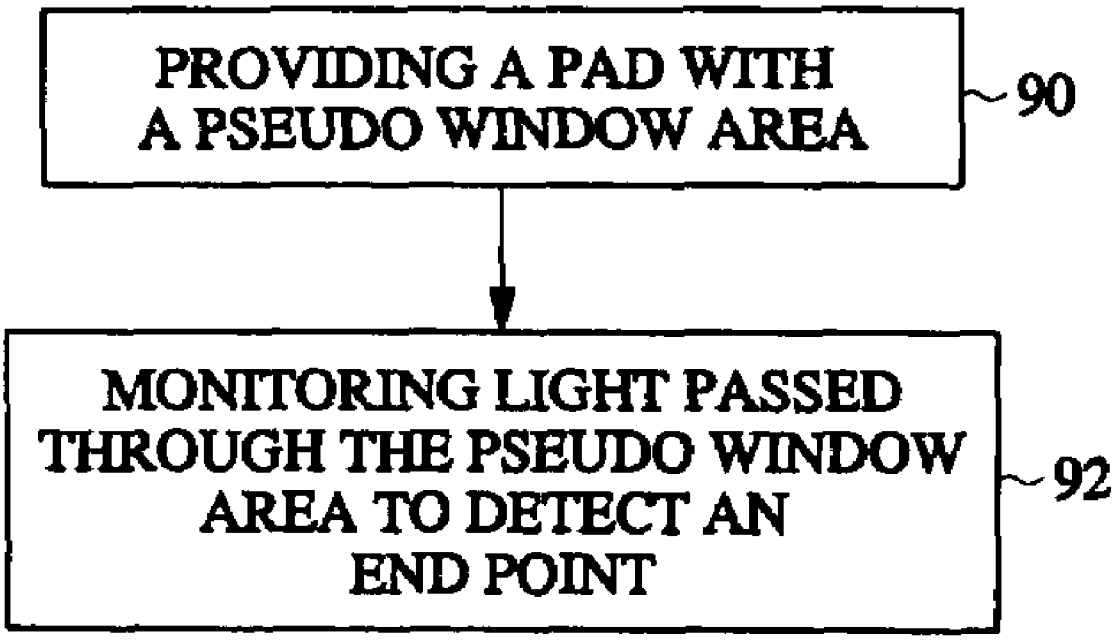
FIG. 9 illustrates a method of detecting an end point in situ in accordance with another exemplary embodiment of the present invention.

FIG. 9 illustrates a method of detecting an end point in situ in accordance with another exemplary embodiment of the present invention. As illustrated, the flowchart of FIG. 9 includes a step 90 of providing a pad with a pseudo window area and a step 92 of monitoring light passed through the pseudo window area to detect the end point.

As described above, in other exemplary embodiments, the various pad and platen features of the present invention illustrated in FIGS. 1–5 may be utilized either singly or in any combination in any of the embodiments illustrated in FIGS. 6–9.

As also described above, in exemplary embodiments, the various monitoring, manufacturing, and/or detecting features of the present invention illustrated in FIGS. 6–9 may be utilized in an in-situ end point detection (EPD) system; such an exemplary optical system is illustrated in U.S. Pat. No. 5,433,651.

In exemplary embodiments of the present invention, the pad is described as a CMP pad, however the exemplary pads disclosed herein may also be used for other types of polishing as would be known to one of ordinary skill in the art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A chemical mechanical polishing (CMP) table having a monitoring function for monitoring a CMP process in-situ, the CMP table comprising:

a polishing pad including an in-situ window area that is thinner than the polishing pad adjacent to the in-situ window area; and a platen attached to a side of the polishing pad opposite to a polishing side; wherein the in-situ window area is composed of the same material layer as the polishing pad adjacent to the in-situ window area, and the platen has a hole which is vertically aligned with the in-situ window area, and the platen has a platen window made of a transparent material in the hole of the platen to provide a void between the in-situ window area and the platen window.

2. The CMP table according to claim 1, wherein the in-situ window area has a thickness of 1.0 to 2.0 mm.

3. The CMP table according to claim 1, wherein the polishing pad is made of at least one of syndiotactic 1,2-polybutadiene, polyurethane, and PBD.

4. The CMP table according to claim 1, wherein the transparent material is at least one of polycarbonate, polyethylene tereplithalate glycol, polypropylene, 2-aryl glycol carbonate, quartz, and glass.

5. The CMP table according to claim 1, wherein the platen window is flush with the platen.

6. A chemical mechanical polishing (CMP) table having a monitoring function for monitoring a CMP process in-situ, the CMP table comprising:

a polishing pad including an in-situ window area that is thinner than the polishing pad adjacent to the in-situ window area; and a platen attached to a side of the polishing pad opposite to a polishing side; wherein the in-situ window area is composed of the same material layer as the polishing pad adjacent to the in-situ window area, and the platen has a hole which is vertically aligned with the in-situ window area, the platen has a platen window made of a transparent material in the hole of the platen, the hole separating the in-situ window area and the platen window, and the platen window protrudes into the hole toward the in-situ window area.

7. A chemical mechanical polishing (CMP) table having a monitoring function for monitoring a CMP process in-situ, the CMP table comprising:

a polishing pad including an in-situ window area that is thinner than the polishing pad adjacent to the in-situ window area; and a platen attached a side of the polishing pad opposite to a polishing side; wherein the in-situ window area is composed of the same material layer as the polishing pad adjacent to the in-situ window area, and the platen has a hole which is vertically aligned with the in-situ window area, the platen has a platen window made of a transparent material in the hole of the platen, and the platen window protrudes from the platen to fill a void between the platen window and the in-situ window area.

8. A chemical mechanical polishing (CMP) table having a monitoring function for monitoring a CMP process in-situ, the CMP table comprising:

a polishing pad including an in-situ window area that is thinner than the polishing pad adjacent to the in-situ window area;

a platen attached to a side of the polishing pad opposite to a polishing side; and a transparent supporting layer arranged between the in-situ window area and the platen; wherein the in-situ window area is composed of the same material layer as the polishing pad adjacent to the in-situ window area, and the platen has a hole which is vertically aligned with the in-situ window area, the platen has a platen window made of a transparent material in the hole of the platen, the hole separating the in-situ window area and the platen window.

9. The CMP table according to claim 8, wherein the platen window protrudes from the platen and the transparent supporting layer is recessed from the polishing pad.

10. The CMP table according to claim 8, wherein the platen window is recessed from the platen and the transparent supporting layer protrudes from the polishing pad.

11. The CMP table according to claim 8, wherein the transparent supporting layer fills a space between the in-situ window area and the platen.

* * * * *